US009611662B2

(12) United States Patent
Bini

(10) Patent No.: US 9,611,662 B2
(45) Date of Patent: Apr. 4, 2017

(54) ANCHORING MECHANISMS FOR A BINISHELL

(71) Applicant: Nicoló Bini, Beverly Hills, CA (US)

(72) Inventor: Nicoló Bini, Beverly Hills, CA (US)

( * ) Notice: Subject to any disclaimer, the term of this patent is extended or adjusted under 35 U.S.C. 154(b) by 0 days.

(21) Appl. No.: 14/663,292

(22) Filed: Mar. 19, 2015

(65) Prior Publication Data

US 2015/0361680 A1 Dec. 17, 2015

Related U.S. Application Data

(60) Provisional application No. 62/010,942, filed on Jun. 11, 2014.

(51) Int. Cl.
*E04B 1/34* (2006.01)
*E04G 11/04* (2006.01)
(Continued)

(52) U.S. Cl.
CPC ..... *E04G 11/045* (2013.01); *E04B 1/32* (2013.01); *E04B 1/166* (2013.01); *E04B 2001/3264* (2013.01)

(58) Field of Classification Search
CPC ..... B29C 44/14; E04G 11/04; E04G 11/045; E04B 1/169; E04B 2001/3217;
(Continued)

(56) References Cited

U.S. PATENT DOCUMENTS 2,388,701 A * 11/1945 Neff ..... E04G 11/04 249/27
2,979,064 A * 4/1961 Fischer ..... E04H 15/20 135/115

(Continued)

FOREIGN PATENT DOCUMENTS

GB 1161396 A 8/1969
GB 1534331 A 12/1978
WO WO 2015/191591 A1 12/2015

OTHER PUBLICATIONS

International Search Report and Written Opinion issued in International Application No. PCT/US2015/034918, mailed Oct. 15, 2015.

*Primary Examiner* — Brian Mattei
*Assistant Examiner* — Gisele Ford
(74) *Attorney, Agent, or Firm* — Mintz Levin Cohn Ferris Glovsky and Popeo, P.C.

(57) ABSTRACT

Described is an assembly for erecting a reinforced structure of a hardening building material using a pneumoform. The assembly includes an anchor bar having a first portion secured to a foundation and a second portion; a clamp bar configured to be aligned with the second portion of the anchor bar; a fixation element configured to extend through the clamp bar and the second portion of the anchor bar; and a pneumoform having an outer perimeter incorporating a keder. The outer perimeter of the pneumoform is positionable within a space between the second portion of the anchor bar and the clamp bar such that upon locking the clamp bar to the anchor bar with the fixation element the keder is captured by the clamp bar creating a first seal and forming a fluid-tight internal volume configured to be inflated. Related assemblies and methods are described.

25 Claims, 15 Drawing Sheets

(51) Int. Cl.
*E04B 1/32* (2006.01)
*E04B 1/16* (2006.01)

(58) Field of Classification Search
CPC ..... E04B 2001/3264; E04B 1/166; E04B 2001/0061; Y10S 425/014; E04H 15/20; E04H 15/644; E04H 15/18
See application file for complete search history.

(56) References Cited

U.S. PATENT DOCUMENTS 3,118,010 A * 1/1964 Harrington ..... E04G 11/04 249/65
3,225,413 A * 12/1965 Bird ..... E04G 11/04 264/314
3,277,219 A * 10/1966 Turner ..... B29C 44/14 249/27
3,462,521 A * 8/1969 Bini ..... E04B 1/169 249/63
3,643,910 A * 2/1972 Heifetz ..... E04B 1/169 249/13
3,686,818 A * 8/1972 Bini ..... E04H 15/20 264/32
3,719,341 A * 3/1973 Harrington ..... E04G 11/04 249/65
3,751,862 A * 8/1973 Linecker ..... E04H 15/20 135/119
4,041,671 A * 8/1977 Nicholson ..... E04B 1/166 52/2.15
4,047,335 A * 9/1977 Darmstadt ..... E04H 15/20 52/2.17
4,064,663 A * 12/1977 Moss ..... E04B 1/166 52/309.9
4,160,523 A * 7/1979 Stevens ..... A01G 9/243 126/400
4,170,093 A * 10/1979 Cappellini ..... E04B 1/169 264/32
4,192,105 A * 3/1980 Morgan ..... E04H 15/20 52/2.25
4,446,083 A * 5/1984 Nicholls ..... E04B 1/169 264/240
4,452,017 A * 6/1984 Tang ..... E04H 15/22 264/32
4,629,592 A * 12/1986 Harrington ..... E04G 11/04 249/19
5,177,919 A * 1/1993 Dykmans ..... B65D 88/34 405/229
5,522,181 A * 6/1996 Ellsworth ..... E04B 1/169 135/904
5,579,609 A * 12/1996 Sallee ..... B64G 9/00 156/156
5,675,941 A * 10/1997 Dykmans ..... B65D 88/34 264/32
5,918,438 A * 7/1999 South ..... E04B 1/169 264/32
2003/0019515 A1* 1/2003 Fritzche ..... E04H 15/20 135/121
2004/0045227 A1* 3/2004 South ..... E04B 1/169 52/80.1
2007/0094938 A1* 5/2007 Thoeny ..... E04H 15/20 52/2.11
2008/0313969 A1* 12/2008 Colucci ..... G03B 21/585 52/2.18
2009/0145046 A1* 6/2009 Thoeny ..... E04H 15/20 52/2.15
2010/0011674 A1* 1/2010 Crettol ..... E04C 3/005 52/2.11

* cited by examiner

420

ANCHORING MECHANISMS FOR A BINISHELL

CROSS REFERENCE TO PRIORITY DOCUMENT

The present application claims the benefit of priority to U.S. Provisional Application Ser. No. 62/010,942, filed Jun. 11, 2014, the full disclosure is incorporated by reference herein in its entirety.

FIELD

The subject matter described herein relates to anchoring mechanisms for Binishells and similar structures.

BACKGROUND

In 1964, Dante N. Bini built the first hemispherical thin shell structure by pneumatically and automatically lifting all the necessary construction materials, which were distributed horizontally over a pneumatic form anchored to a circular ring beam, from ground level into an hemispherical dome typically having an elliptical section. After the initial ground preparation was finished, that concrete thin shell structure was erected via air pressure in 60 minutes.

The term, Binishells, was previously used to refer to a type of hemispherical and/or elliptical thin shell structure. Specifically, the Binishells originally referred to a reinforced concrete structure erected over a circular footing ring beam and fabricated by pouring concrete on an inflatable pre-shaped and inelastic membrane, inflating the membrane, and then allowing the resulting reinforced concrete dome to cure. This method of construction produces circular-based, monolithic, reinforced concrete shell structures, with hemispherical and/or elliptical sections ranging in size from 12 to 40 meters in diameter. Over 1,500 of these Binishells-based buildings are in use in 23 countries. U.S. Pat. No. 3,462,521 entitled "Method of Erecting Structures" describes an example of a method for erecting the Binishells-structure and is incorporated by reference in its entirety.

SUMMARY

The subject matter disclosed herein provides methods and apparatus for fabricating (e.g., erecting, lifting, shaping, etc) thin-shell reinforced structures of hardening building materials using a pneumoform. Also described are anchoring mechanisms and assemblies for erecting such reinforced structures.

In one aspect, there are provided systems, devices, and methods for erecting a reinforced structure of a hardening building material using a pneumoform. The assembly includes an anchor bar having a first portion secured to a foundation and a second portion; a clamp bar configured to be aligned with the second portion of the anchor bar; a fixation element configured to extend through the clamp bar and the second portion of the anchor bar; and a pneumoform having an outer perimeter incorporating a keder. The outer perimeter of the pneumoform is positionable within a space between the second portion of the anchor bar and the clamp bar such that upon locking the clamp bar to the anchor bar with the fixation element the keder is captured by the clamp bar creating a first seal and forming a fluid-tight internal volume configured to be inflated.

A portion of an external surface of the pneumoform can be urged against the keder upon application of pressure against an internal surface of the pneumoform creating a second seal and forming a pocket around at least a portion of the fixation element. The second seal can prevent hardening building material applied to the pneumoform from entering the pocket and contacting the at least a portion of the fixation element. Removal of the pressure can deflate the internal volume and reveal the at least a portion of the fixation element. The at least a portion of the fixation element can be removable and the pneumoform can be removable from the assembly. The pneumoform can be reusable after it is removed. The pneumoform can have a double wall configured to be inflated internally. One or more regions of the clamp bar can be covered with a cushioned material. The keder can be prevented from being pulled through the space. Inflating the fluid-tight internal volume of the pneumoform can create a freeform shape. The pneumoform can be formed of a reinforced material that locks into position once a certain shape is achieved. The pneumoform can be formed of an elastomeric material. The pneumoform can have a single wall.

The anchor bar can have a first hole extending through the second portion. The clamp bar can have a second hole extending through the clamp bar. The fixation element can extend through a bore created when the first and second holes align. The fixation element can extend through a portion of the outer perimeter of the pneumoform positioned within the space when it extends through the bore. The fixation element can be a bolt having a shaft and a head. The shaft can extend through the bore from an internal side of the pneumoform to an external side of the pneumoform such that the head of the bolt remains on the internal side of the pneumoform. The shaft of the bolt can be secured with a lock nut or lock washer on the external side of the pneumoform locking the clamp bar to the anchor bar. The keder can be positioned along an upper surface of the clamp bar such that the pneumoform extends from the space under a lower surface of the clamp bar. The first seal can form collectively between the keder, the anchor bar and the clamp bar locked to the anchor bar. Inflating the pneumoform can increase internal air pressure within the fluid-tight volume. A portion of an external surface of the pneumoform can be urged against the keder forming a second seal. The second seal can form automatically upon inflating the fluid-tight internal volume. Inflating the internal volume can include injecting air using a blower, compressor or compressed air tank. Inflating the internal volume can include applying a pressure against an internal surface of the pneumoform pushing the pneumoform outward. The first and second seals can be each configured to maintain a seal during inflation of the internal volume and upon application of an internal pressure. The second seal can form a pocket around the clamp bar and the head of the bolt. The head of the bolt can be positioned within the pocket between the clamp bar and the pneumoform.

The assembly can further include a rebar matrix assembled over the inflated pneumoform. The first and second seals can be each configured to maintain a seal during applying of a hardening building material. The second seal can prevent the hardening building material applied to the pneumoform from entering the pocket and contacting the head of the bolt. Applying the hardening building material can include pouring the hardening building material. Applying the hardening building material can include spraying the hardening building material. The hardening building material can include concrete, shotcrete, gunite, or other hardening building material.

The head of the bolt can be revealed upon deflating the pneumoform. The bolt can be configured to be accessed and removed from the bore after deflating the pneumoform. The pneumoform can be configured to be recovered by disengaging the outer perimeter from within the space between the anchor bar and the clamp bar. The disengaged pneumoform can be reusable to fabricate a second reinforced structure of hardening building material.

In an interrelated aspect, disclosed is a method of fabricating a reinforced structure of hardening building material using a pneumoform shaped by air pressure. The method includes securing a first portion of an anchor bar to a foundation; positioning an outer perimeter of a pneumoform within a space between a second portion of the anchor bar and a clamp bar, the outer perimeter incorporating a keder; preventing the keder from being pulled through the space; and inflating the pneumoform to create a freeform shape.

The anchor bar can have a first hole extending through the second portion and the clamp bar can have a second hole extending through the clamp bar. The first and second holes can align to create a bore through which a fixation element is configured to be inserted. The method can further include inserting the fixation element through the bore and a portion of the outer perimeter of the pneumoform positioned within the space. The fixation element can be a bolt having a shaft and a head. Inserting the fixation element can include extending the shaft through the bore from an internal side of the pneumoform to an external side of the pneumoform such that the head of the bolt remains on the internal side of the pneumoform. The shaft of the bolt can be secured with a lock nut or lock washer on the external side of the pneumoform locking the clamp bar to the anchor bar. The method can further include positioning the keder along an upper surface of the clamp bar such that the pneumoform extends from the space under a lower surface of the clamp bar. The method can further include creating a fluid-tight volume within the pneumoform by forming a first seal. The first seal can form collectively between the keder, the anchor bar and the clamp bar locked to the anchor bar.

Inflating the pneumoform can increase internal air pressure within the fluid-tight volume. The method can further include urging a portion of an external surface of the pneumoform against the keder forming a second seal. The second seal can form automatically upon inflating the pneumoform. Inflating the pneumoform can include injecting air into the fluid-tight volume using a blower, compressor or compressed air tank. Inflating the pneumoform can include applying a pressure against an internal surface of the pneumoform pushing the pneumoform outward. The first and second seals can each be configured to maintain a seal during inflation of the pneumoform. Forming the second seal can include forming a pocket around the clamp bar and the head of the bolt. The head of the bolt can be positioned within the pocket between the clamp bar and the pneumoform.

The method can further include assembling a rebar matrix over the inflated pneumoform. The method can further include performing a slump test on the rebar matrix and the inflated pneumoform. The method can further include applying a hardening building material over the rebar matrix. Applying the hardening building material can include pouring the hardening building material. Applying the hardening building material can include spraying the hardening building material. The hardening building material comprises concrete, Shotcrete, Gunite or other hardening building material. Spraying can include pneumatically projecting the hardening building material over the inflated pneumoform. The first and second seals can each be configured to maintain a seal during applying the hardening building material. The second seal can prevent the hardening building material applied to the pneumoform from entering the pocket and contacting the head of the bolt. The method can further include continuously troweling the hardening building material while applying it. The method can further include maintaining constant air pressure while the hardening building material sets to a specific compressive self-supporting strength.

The method can further include deflating the pneumoform. Deflating the pneumoform can include revealing the head of the bolt. The method can further include accessing and removing the bolt in the pocket from the bore. The method can further include recovering the pneumoform by disengaging the outer perimeter from within the space between the anchor bar and the clamp bar. The method can further include reusing the pneumoform to fabricate a second reinforced structure of hardening building material. The second reinforced structure can have a shape that is the same or different as the first reinforced structure. The foundation can include a slab coupled to a first ring beam defining an outer perimeter of the reinforced structure. The foundation can further include a second ring beam defining an inner perimeter of the reinforced structure.

The above-noted aspects and features may be implemented in systems, apparatus, and/or methods, depending on the desired configuration. The details of one or more variations of the subject matter described herein are set forth in the accompanying drawings and the description below. Features and advantages of the subject matter described herein will be apparent from the description and drawings, and from the claims.

DETAILED DESCRIPTION

The subject matter disclosed herein provides methods and apparatus for fabricating (e.g., erecting, lifting, shaping, etc) thin-shell reinforced structures of hardening building materials using a pneumoform. Also described are anchoring mechanisms and assemblies for erecting such reinforced structures.

Described herein are anchoring mechanisms and assemblies for erecting a reinforced structure of a hardening building material in the fabrication of structures, such as Binishells, freeform Binishells or thin-shell structures that are shaped by air pressure. The structures are generally very fast and inexpensive to construct as well as benefitting from relatively high strength and a reduced carbon footprint compared to conventional construction. The structures have a variety of uses including housing, storage buildings, schools and the like.

Figure 1:
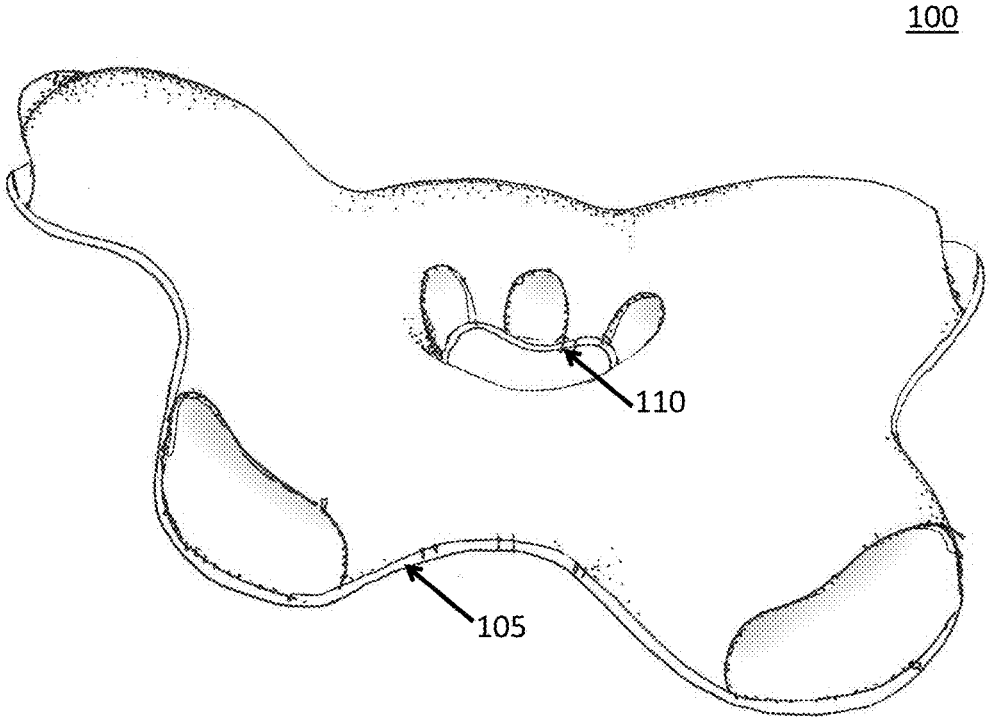
FIG. 1 is a perspective view of an implementation of a fabricated structure.

FIG. 1 depicts an example of a completed structure 100 fabricated using a pneumoform. The structure 100 can have a simple geometric shape such as a rectilinear or other shape. The structure 100 can have a freeform shape including an outer perimeter 105 and, optionally an inner perimeter 110. The freeform shape is freeform in the sense that the overall shapes of the outer and inner perimeters 105 and 110 are not limited to a simple geometric shape, e.g., a circle, an ellipse, a square, and the like. Instead, the outer and inner perimeters 105 and 110 of the structure 100 can have any shape whether irregular or asymmetrical, curvilinear or rectilinear. The inner perimeter 110 may be used as a garden, inner courtyard, light well, etc. Although FIG. 1 depicts only a single inner perimeter 110 forming an inner courtyard, more or fewer inner perimeters may be implemented as well (see, e.g., FIGS. 9A-9F).

Pneumoform stands for PNEUMatic FORMwork and can also be referred to as an "airform." It should be appreciated that use of the terms "pneumoform" or "pneumatic formwork" or "membrane" is not intended to be limiting. The pneumoform can take a variety of forms including having a base layer or double layer, which will complete the air seal internally. The pneumoform can have a single wall. The pneumoform may also have a double wall that is inflated internally to create the desired shape and/or have webbing pinch point(s), cables, baffles and/or other designed elements to control or alter the inflated shape as will be described in more detail herein. The pneumoform can be formed of a reinforced material such that it locks into position once a certain shape is achieved. Alternatively, the pneumoform can be formed of an elastomeric material.

Although structure 100 may be fabricated in a variety of ways, the following description provides a process for fabricating a structure 100, such as freeform Binishells. It should be appreciated that this is an example of a fabrication process and is not intended to be limiting.

Figure 2:
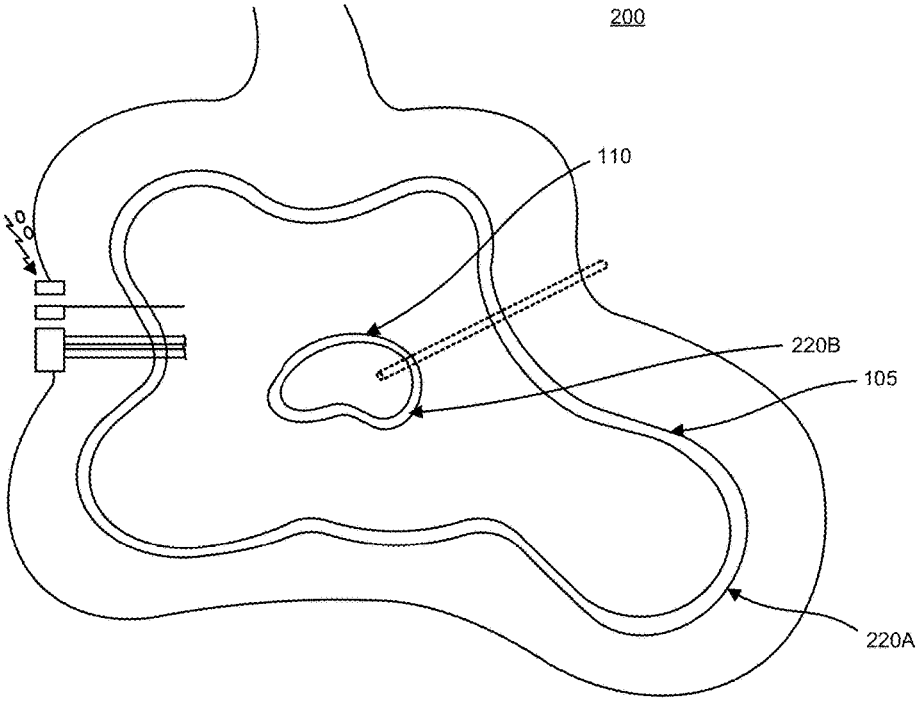
FIG. 2 is a schematic view of an example of a site being prepared for fabrication of a structure.

FIG. 2 depicts a site 200 which may be prepared during an early phase in the construction of the structure 100. Phase 1 generally relates to preparation of the site 200 onto which the structure 100 is constructed. The preparation may include one or more of the following: providing water, sewer and electricity to site 200; leveling and compacting the soil or building pad; digging a perimeter trench or other formwork to provide a footing for the structure 100; installing a moisture barrier membrane on top of the soil (which is typical of slab on grade construction); and placing blowers and/or compressors, generators, air ducts, valve, shape/height controlling devices, and the like. In some implementations, the site 200 on which the structure 100 is located should be selected to be no more than two hours from a concrete batching plant as some concretes, even when mixed with retarding agents, may start curing after traveling more than two hours and may reach a consistency which makes the concrete difficult for the inflation process to work smoothly. Alternatively, one or more on-site concrete mixers may be used. In some implementations, the structure 100 may use geopolymer concrete rather than Portland Cement, although Portland Cement may be used as well. An example of geopolymer concrete that may be used in the structure 100 is fly ash. It should be appreciated that use of the term "concrete" herein is not intended to be limiting and that other hardening building materials can be used such as Shotcrete, Gunite, etc.

Around the outer perimeter 105 a trench 220A can be dug, and around the inner perimeter 110 another trench can be dug 220B. The trenches 220A-B may be dug around the outer perimeter 105 and inner perimeters 110 in whatever shape is specified (e.g., per the architectural and/or engineering drawings). As noted the outer and inner perimeters 105 and 110 may be freeform. The freeform shape of each of the outer and inner perimeters 105 and 110 may be of almost any shape and may have curvilinear segments and/or straight-line segments within it. The inner perimeter 110 may provide interior support point(s) to the structure 100. Moreover, the inner perimeter 110 may be configured as an interior courtyard, garden, and the like. Moreover, wherever there is an inner perimeter 110 forming, for example, an interior courtyard, the structure 100 may be designed to include a drain mechanism to provide drainage (or some other type of water handing mechanism) for any rainwater that will flow into the inner perimeter, e.g., interior courtyard, by virtue of the geometry of the structure 100. Mechanisms to handle water runoff to the outer perimeter 105 from the structure 100 are also typically implemented as well.

Figure 3:
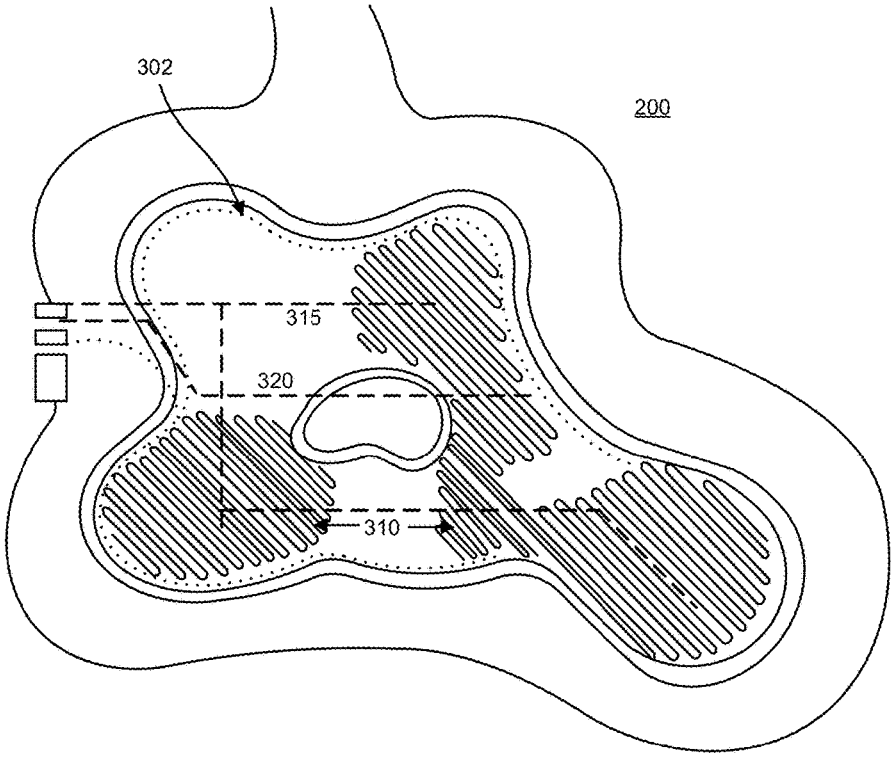
FIG. 3 is a schematic view of the site of FIG. 2 during a stage of a fabrication process.

FIG. 3 depicts the site 200 during Phase 2 of the fabrication process. Phase 2 generally includes preparing the slab on grade foundation. It should be appreciated that other foundations can be used including but not limited to pile, raised, matt, raft, and other foundation types. Phase 2 may include one or more of the following: installing electrical conduits 302, installing AC ducts 315 with insulation; installing radiant heat coils 310 (which may be installed in the slab); and installing plumbing 320 with insulation to stub outs. Although FIG. 3 depicts locations of electrical, AC ducts, and radiant heat coils, the locations may vary in accordance with, for example, architectural and/or mechanical drawings given a specific structure 100 design. In some implementations, the electrical conduits 302, AC ducts 315, radiant heat coils 310, plumbing 320, and stub outs can be located and installed within the slab, below the floor slab or within a crawl space. For other implementations, such as larger structures, the AC ducts 315, electrical conduits 302 and units as well as other mechanical components may be housed in a second floor or mezzanine level or elsewhere.

Figure 4:
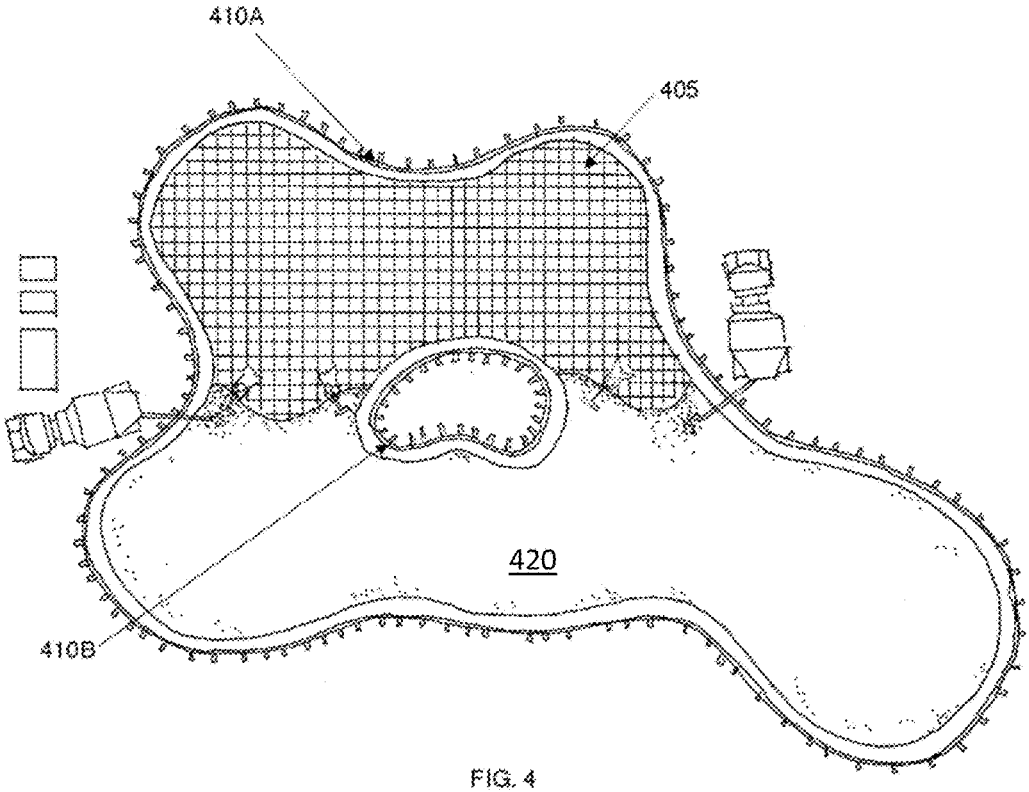
FIG. 4 is a schematic view of the site of FIG. 2 during a stage of a fabrication process.

FIG. 4 depicts the site 200 during Phase 3 of the fabrication process. Phase 3 may include one or more of the following: preparing formwork 410A-B and, for example, support pegs for concrete ring beams and/or other foundation systems and placing rebar reinforcement 405 for slab 420. The formwork 410A-B can provide the form for the ring beams defining the outer and inner perimeters 105, 110. The ring beams can function as a mechanism to which the membrane (also referred to herein as a pneumoform or a pneumatic formwork) can be attached as described further below. Additionally, because the weight of the resulting structure 100 bears down on the perimeter of the slab 420, the ring-beam, which runs the perimeter, can serve to support the structure 100 and to transfer its load to the soil below. As many structural features, such as an arch, a dome or dome-like structure, tend to have an outward thrust, the ring beam can work with the slab 420 to contain this outward thrust. Additionally, the ring beam may serve to counter the upward forces created by the internal air pressure on the anchoring points along the perimeter of the pneumoform during construction. Once the formwork 410A-B is placed, the concrete can be poured on grade (wherein the soil includes a moisture barrier membrane as noted above), and the poured concrete troweled. The formwork 410A-B (e.g., curvilinear or straight as the case may be) can be placed along the outer perimeter 105 and within the inner perimeter 110 (e.g., within the interior courtyard or columns). The formwork for the slab 420 may be implemented as welded wire reinforcing (or other reinforcing, e.g. rebar), which is implemented upon (e.g., on top of) a moisture barrier membrane laid on grade. The slab 420 can be poured before the ring beams defined by the formwork 410A-B is poured, although the ring beam may be poured before the slab 420 as well or concurrently with the slab 420. In either case, portions of the reinforcing steel 405 for the slab 420 and that of the ring beam can overlap and/or tie into each other to allow the ring beam and the slab 420 to work together as a system.

Figure 5:
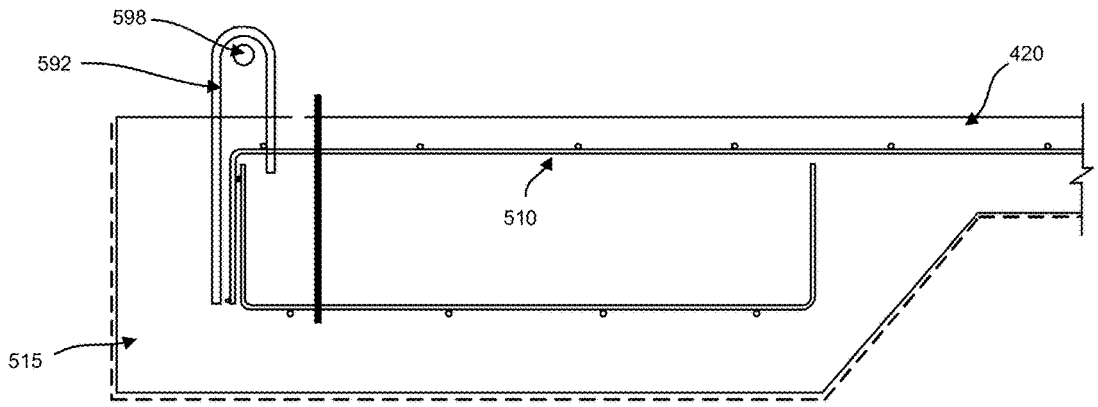
FIG. 5 is a cross-sectional view of a portion of a foundation for a fabricated structure during a stage of a fabrication process.
Figure 8:
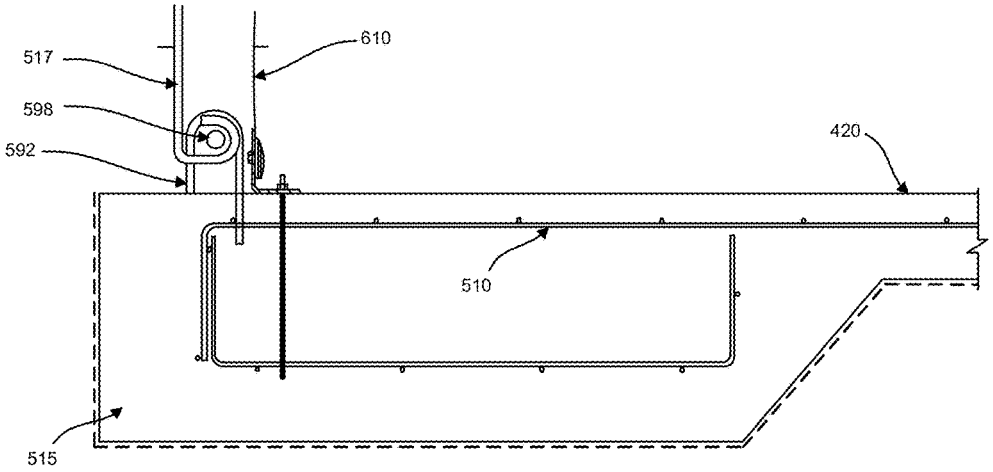
FIG. 8 is a cross-sectional view of a portion of a foundation for a fabricated structure during a stage of a fabrication process.
Figure 9A:
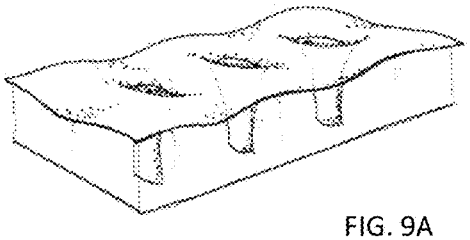
FIGS. 9A-9L depict examples of structure shapes.
Figure 9D:
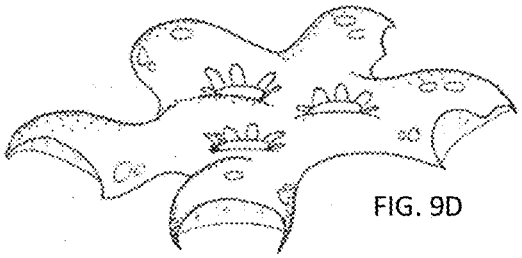
Figure 9B:
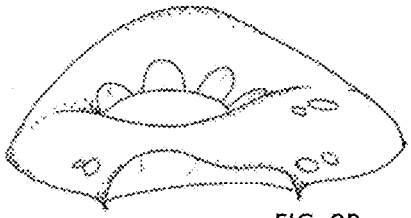
Figure 9E:
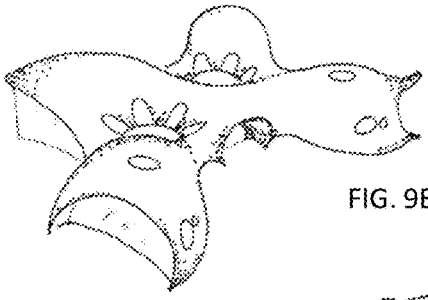
Figure 9C:
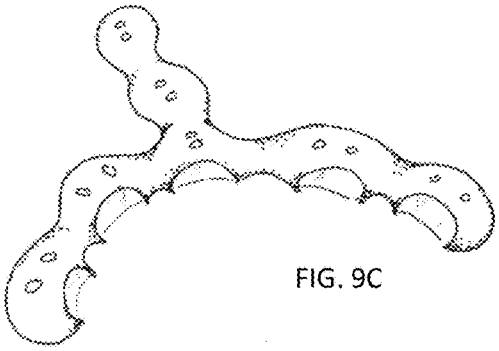
Figure 9F:
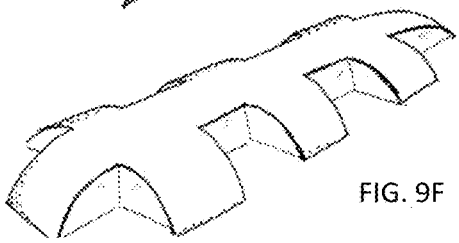
Figure 9G:
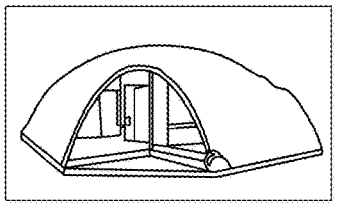
Figure 9J:
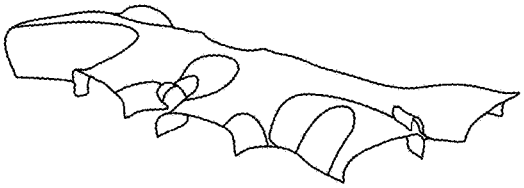
Figure 9H:
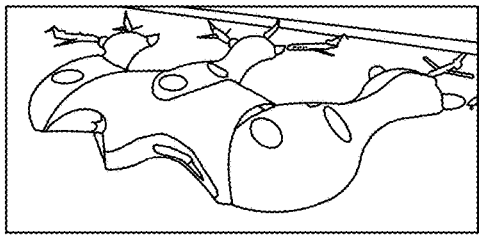
Figure 9K:
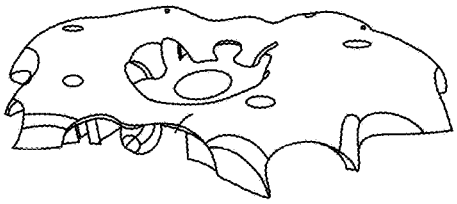
Figure 9I:
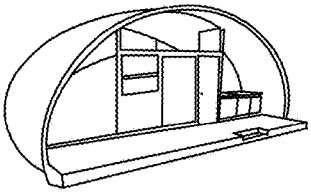
Figure 9L:
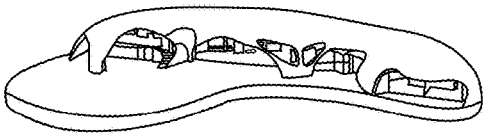

FIG. 5 depicts a cross-section of an implementation of the perimeter ring beam 515, which can be fabricated during Phase 4 of the process. Phase 4 can include one or more of the following: placing a pre-formed rebar and/or welded wire mesh 510 in the trench 220 at the outer and inner perimeters 110, 105; locating the rebar ties; tying into the slab on grade reinforcement; and pouring and, in some cases, vibrating the concrete ring beam 515. The pre-formed rebar 510 can be pieces of traditional rebar and/or welded wire mesh that may be shaped off-site to provide the ideal shape to their purpose. They can be located in a radial or other pattern within the ring-beam trench and can be shaped to perform in a number of ways: they can capture, support and/or position the steel flat bar or 'L' bar or other method used to anchor the pneumoform; they can provide the anchor hoops 592 for the rebar perimeter tie rod 598 configured on top of the ring beam 515; they can facilitate the positioning of the rebar reinforcements 517 (see FIG. 8); and they can add to the reinforcement of the perimeter ring beam 515. Portions of the foundation (and in this case the ring beam 515 and the slab 420) can be connected structurally to allow them to work as a system. This can be done by allowing for the overlap between adjacent pieces of the re-bar of the slab 420 and that of the ring beam 515 and/or by tying the two together before one or the other is poured.

The perimeter ring beam 515 can be used to structurally tie the rebar reinforcements of the structure to those of the foundation, for example, using a hook at the extreme ends of the reinforcement running the perimeter. The hooks can capture the perimeter tie rod 598, connecting it structurally to the foundation. In any scenario, the reinforcement should be located and provided in the number, quantity and pattern specified in the engineering drawings. It should be appreciated that the use of the term 'rebar', 'welded wire mesh' or 'steel reinforcement' are not intended to be limiting and that other reinforcing materials such as glass fiber, bamboo, plastics, fiberglass, meshes etc. can be used.

Figure 6:
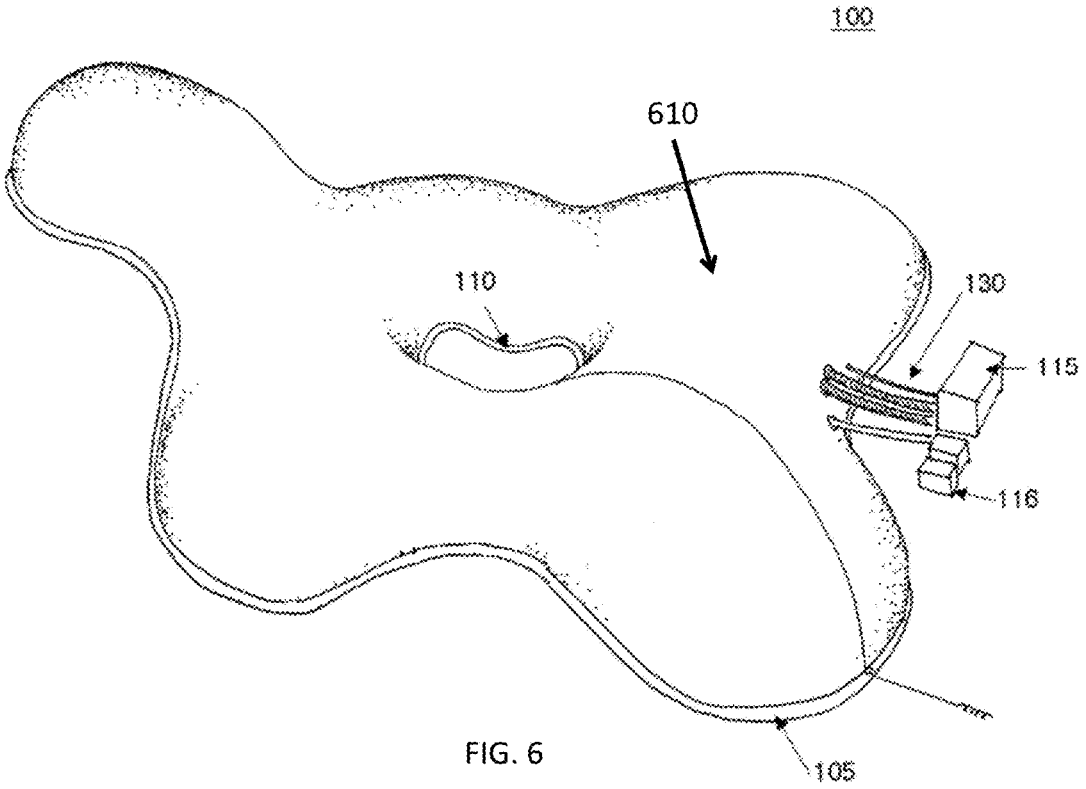
FIG. 6 is a perspective view of a pneumoform during a stage in the construction process.

FIG. 6 depicts a pneumoform 610 used to shape the structure 100. The pneumoform 610 can be installed in Phase 5 of the fabrication process. Phase 5 also may include performing a test inflation. The pneumoform 610 can be unrolled and laid upon the slab 420 after it has cured. The pneumoform 610 can be pre-fitted along the perimeter of the structure 100 with a sealed anchoring system, for example, the anchoring system shown in FIGS. 11-12 and described in more detail below. The pneumoform 610 can be laid along the perimeter of the ring beam 515 and along any courtyards within the perimeter 110. Flexible tubes 130 can be attached to blowers 115 and compressors 116 (or the compressed air tanks) and the pneumoform 610 via clamps, which can be pre-fitted to the membrane 610. The blowers 115 and compressors 116 can be coupled to the pneumoform 610 from the underside of the foundation or may be attached to a membrane at or near ground level. For example, the tubes 130 from the blowers 115 and compressors 116 can be attached as shown at FIG. 6. In some cases, compressed air tanks may be substituted for the blowers 115 and compressors 116. FIG. 6, depicts the inflated pneumoform 610 anchored to the ring beam or other portion of the foundation running its perimeter. The method for anchoring and sealing the pneumoform to the foundation is described in detail below. Once anchored and sealed, the pneumoform 610 can be inflated to test the air-tightness of both the pneumatic seal and the pneumoform 610 as well as to test the shape the pneumoform 610 will assume. In some implementations, the shape of the inflated pneumoform 610 is tested empirically through cables that measure the height and shape the membrane assumes.

Figure 7:
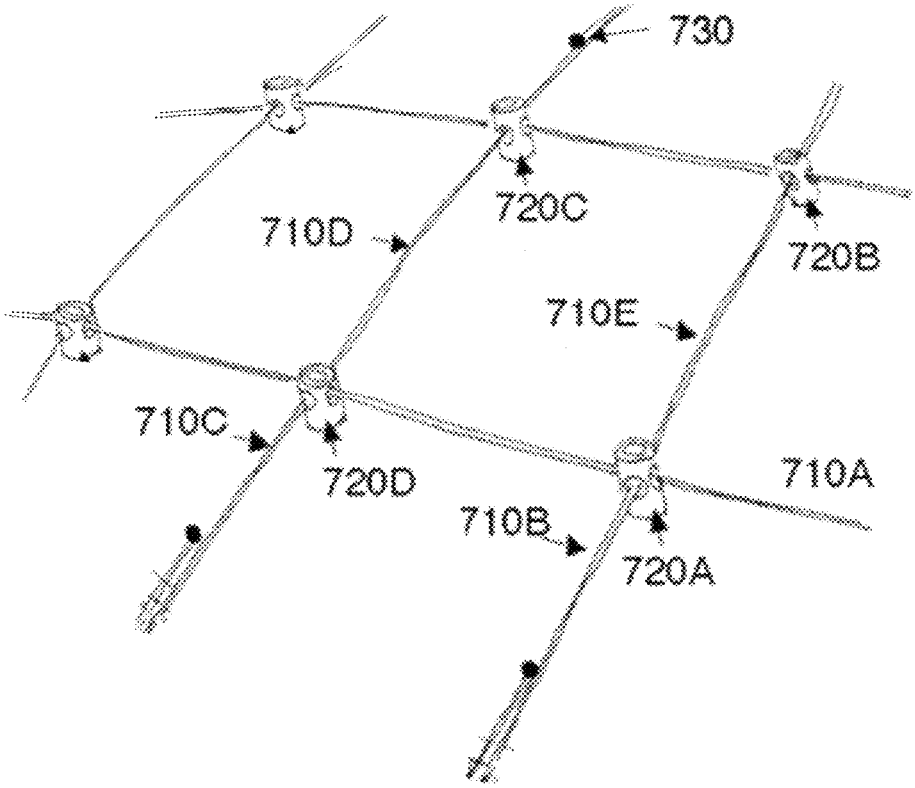
FIG. 7 is a partial view of a configuration of reinforcement for use with a pneumoform of a structure during a stage of a fabrication process.

Once the pneumoform is inflated using blowers 115 or compressors 116, a steel reinforcement bar or rebar matrix or other reinforcement system can be assembled upon the membrane and the building material, such as concrete, applied such as by pouring or spraying. FIG. 7 depicts a configuration of reinforcement bars 710A-E positioned on top of inflated pneumoform 610. The reinforcement bars 710A-E can provide reinforcement for the concrete that will be applied to the pneumoform 610. The reinforcement bars 710A-E can be lengths of traditional rebar positioned on traditional rebar chairs and/or custom spacers 720A-D and attached at one end to the perimeter tie rod 598 (see FIG. 8). The other end of the reinforcement bars 710A-E can be capped with a cap 730 such as a PVC cap to minimize the risk or tearing the pneumoform 610 and can overlap with another piece of reinforcement bar 710A-E also positioned on the chairs and/or threaded through the custom spacers 720A-D, also capped on its free end and attached at the opposite end to the perimeter tie rod 598 (see, e.g., FIG. 8). The two pieces of adjacent reinforcement bars 710A-E can be cut and sized so that they overlap enough to allow the reinforcement bars 710A-E to be considered structurally continuous. In construction, there are specific distances that adjacent pieces of reinforcement bars 710A-E overlap in order for them to be considered to have the equivalent strength as a continuous piece of reinforcement bars 710A-E. This distance will vary in accordance to the diameter of the reinforcement bars 710A-E and other factors. A calculation can determine the amount of overlap necessary. The reinforcement bars 710A-E are typically installed in Phase 6. For example, the reinforcement bars 710A-E and chairs or spacers 720A-D or other positioning device can be positioned upon the inflated pneumoform 610 per engineering specifications. Traditional chairs of the appropriate size, custom spacers or other means can be used to position the rebar reinforcement within the concrete in a way that can provide tensile reinforcement to the concrete per the engineering specifications. The chairs or spacers 720A-D can be custom fabricated or standard building material and may be formed from material that protects the pneumoform from damage during inflation such as polyvinyl chloride (PVC) or other polymer, rubber, or plastic material. It should also be appreciated that the use of the term 'rebar' or 'steel reinforcement' is not intended to be limiting and that other reinforcing materials such as glass fiber, bamboo, plastics, fiberglass, meshes, etc. may be used alongside or instead of steel reinforcement. Additionally, it should be appreciated that the use of the terms 'chair' or 'spacer' is not intended to be limiting and that other mechanisms such as chain link, coils, or other fabricated components may be used alongside or instead of chairs or spacers to position the reinforcement within the concrete.

FIG. 7 also depicts how the rebar can be positioned in the concrete using chairs or spacers 720A-D or as described above, using other components or materials. In some cases, building codes may require a minimal ⅝" concrete cover around rebar. The reinforcement bars 710A-E can be of a dimension and quantity specified in the engineering drawings. Typically these will be one or more ⅜" diameter bars, but other sizes may be used and/or two three or more ⅜" diameter (or other) bars may be bunched together to provide additional reinforcement. Typically, an engineer will call for additional reinforcements to be located around the perimeter of where the larger openings will be. This can be done by adding as many rebar rods as required to at the locations specified and in the manner specified in the engineering drawings.

Phase 7 includes performing slump tests both at the batching plant and on site and other tests to determine that the concrete mix is as per the specification. Slump tests can be performed both at the batching plant (unless concrete is mixed on site) and on site. The appropriate slump can be determined according to specifications and verified by field inspectors and/or special inspectors. The strength of the concrete can be as specified in accordance with the engineering/architectural designs for the structure 100. The spacing and positioning of the concrete reinforcement may also be reviewed and approved by the field inspector and/or special inspector prior to the application of the concrete. The concrete can then be applied in accordance to a pre-determined pattern to envelope the reinforcing steel mesh and provide the concrete cover and wall thickness as specified in the engineering drawings. The spacers and/or chairs 720A-D can be sized to facilitate measuring and providing a consistent wall thickness. It should be appreciated that use of the term "concrete" herein is not intended to be limiting and the material used to create the shell need not be necessarily poured. For example, the shell material(s) can be sprayed on such as in the case of Shotcrete, or Gunite or other hardening building materials may be used.

During and/or after its application, the concrete may be continuously troweled by hand or both other methods. The application of the concrete structure 100 can be completed in Phase 8 although the curing time of the concrete will depend on a number of factors including temperature, humidity, slump, desired compressive strength, use of additives such as plasticizers and retardants and/or other aspects of the concrete mix etc.

FIGS. 9A-9L depict various shapes for the structure 100, although other shapes may be implemented as well.

As described above, compressors and/or blowers can be used to inflate the pneumoform and maintain the desired shape for the pneumoform throughout the fabrication process. Compressed air tanks can also be substituted for the compressors and/or blowers. The air pressure used to inflate the pneumatic formworks can vary during the construction process. A significantly higher inflation pressure allows for the generation of buildings having a variety of shapes, such as freeform shapes or having double wall membranes etc. The pressure can also vary depending on the amount of concrete that is added at any particular time, the desired and specified thickness of the concrete, the size and shape of the structure and other characteristics of the pneumoform. In some implementations, the inflation pressure can be within a range from about 0.1 psi to about 2.0 psi.

After achieving the desired shape, a constant air pressure can be maintained to allow the concrete to set such that the entire assembly and exterior structure is now self-supporting. The cables used to measure the shape of the pneumoform 610 during the test inflation can be again deployed to empirically indicate when the final shape of the wet structure 100 is achieved. In some cases, concrete is not added to areas where, for example, openings in the structure such as doors and/or windows may be positioned. In these cases, arch beams may be added around the perimeter of the openings to reinforce the structure and per the architectural and engineering specifications. In other cases, arch beams may be added to the structure after the concrete has cured and tied into the existing structure. In these instances, once arch beams are in place and have been allowed to set to reach their required strength, openings may be cut into the structure 100 using traditional means and as indicated in the architectural drawings. Lintels and interior and exterior finishes can be added during or after the curing of the structural walls and per the structure 100 design which is typically specified in architectural drawings.

In Phase 9, after the concrete (or other hardening building material) has set or cured to a specific compressive strength wherein the structure 100 is self-supporting, the compressors can be removed, the pneumoform 610 can be deflated and removed and depending on, for example, the anchoring assemblies used during fabrication, the pneumoform 610 re-used. The pneumoform 610 can be re-used for structures having the same or different shapes. As described herein, the pneumoform may be made of a reinforced material and be pre-formed or the pneumoform can be an elastomeric sheet material. In the case of elastomeric pneumoforms, the shape of the building can change depending on the amount of air pressure used to inflate the pneumoform. In contrast, once a pre-determined or maximum shape is achieved in the inelastic reinforced membrane additional air pressure will generally not affect the final shape. Anchoring systems or elements such as baffles, cables or other materials may be used with the structures 100 to modify the naturally occurring shape of the pneumoform. However, in both the elastomeric and the inelastic membranes, the air pressure can be distributed evenly on the interior surface of the membrane, giving the structure 100 its final shape.

As mentioned above, the membrane or pneumoform can be re-used following fabrication of the structure. Described in more detail below are implementations of anchoring assemblies that provide anchoring support to the pneumoform and that can be removed from the pneumoform after forming the concrete shell such that the pneumoform may be re-used.

Figure 10:
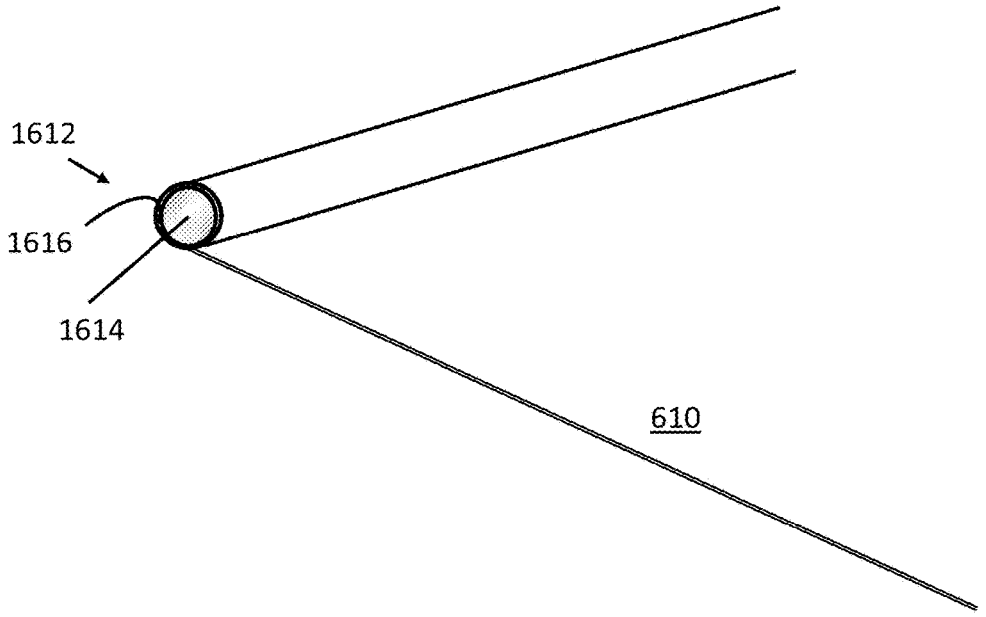
FIG. 10 is a schematic partial view of a pneumoform incorporating a keder.

FIG. 10 shows a partial section of a pneumoform 610 having an outer perimeter incorporating a keder 1612. The keder 1612 includes a solid rail element 1614 that extends through a channel 1616 of the pneumoform 610. The channel 1616 can be formed by overlapping the outer perimeter of the pneumoform 610 onto itself and pinch-welding, sewing, gluing or otherwise attaching the edge of the pneumoform 610 onto itself. Alternatively, the outer perimeter of the pneumoform 610 can be coupled to a heavy-duty fabric such as a coated polyester fabric such as PVC coated polyester or other type of heavy-duty keder fabric or material incorporating the rail element 1614 in the channel 1616. In some implementations, the fabric of the keder 1612 can be PVC fabric reinforced with fiberglass. In some implementations, the fabric of the keder 1612 can be a triple layer perimeter with 2" webbing sewn onto the pneumoform 610. The rail element 1614 extending through the channel 1616 can be a solid plastic or rubber material formed into an elongate rope, threaded steel cables, nylon rope or other material. It should be appreciated that a variety of keder configurations are considered herein.

Figure 11:
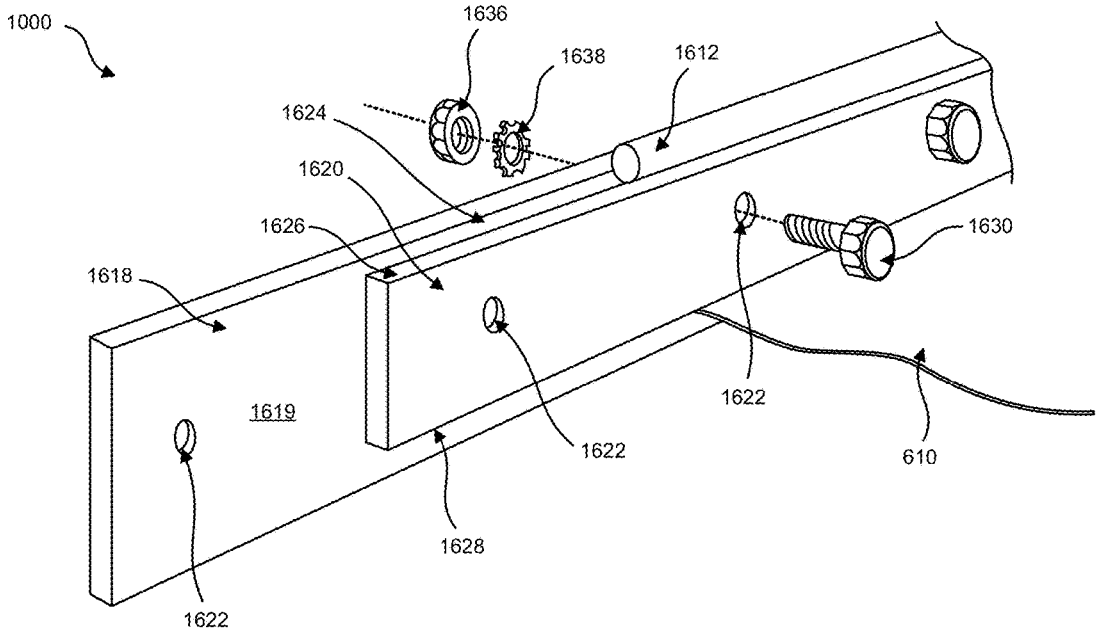
FIG. 11 is a partially exploded view of an implementation of an anchoring assembly for the pneumoform of FIG. 10.
Figure 12:
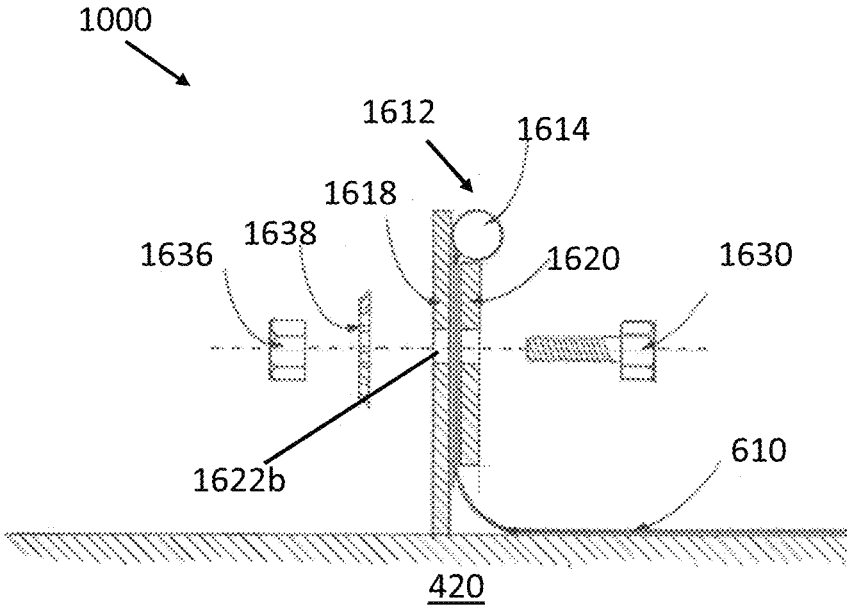
FIG. 12 is a cross-sectional side view of the anchoring assembly of FIG. 11.

FIGS. 11 and 12 depict an implementation of an anchoring assembly 1000 for use with a pneumoform 610 in the fabrication of a structure. The anchoring assembly 1000 can include an anchor bar 1618 and a clamp bar 1620. The anchor bar 1618 is configured to be secured to the slab 420 according to any number of techniques as is known in the art. For example, the anchor bar 1618 can form an L angle having a horizontal portion positioned generally flush with the slab and screwed in place such as with a fixation element such as a bolt, lock nut and lock washer and a vertical portion extending away from the slab 420 such that it can mate with the clamp bar 1620. The anchor bar 1618 can also be set vertically into the perimeter of the foundation and located and/or tied to the foundation reinforcement via all thread and/or other anchoring and positioning devices known in the art prior to pouring of the concrete for the foundation. The anchor bar 1618 can be fixed in other ways to the slab 420. The anchor bar 1618 can be an elongate element having a rectangular or other shape extending along an outer perimeter of the slab 420. Alternatively, the anchor bar 1618 can be a plurality of shorter elements extending along the outer perimeter of the slab 420. In cases where shorter elements may be used, these may be fitted very closely or 'butt jointed' end to end and then welded, soldered or otherwise attached to one another such that air at pressure may not escape between them. The anchor bar can serve a dual purpose. It can anchor the pneumoform to the foundation and it can form a seal with the foundation whereby air may not escape from between the anchor bar and the foundation. It should be appreciated that the shape, dimensions and relative configuration of the anchor bar 1618 can vary. Similarly, the clamp bar 1620 can have a variety of configurations so long as at least a portion of the clamp bar 1620 can mate with a portion of the anchor bar 1618.

Keder 1612 can be captured within a space 1624 between the anchor bar 1618 and the clamp bar 1620 such that the rail element 1614 of the keder 1612 is positioned along an upper surface 1626 of the clamp bar 1620 and the pneumoform 610 clamped between the anchor bar 1618 and the clamp bar 1620 extends out from the space 1624 along a lower surface 1628 of the clamp bar 1620. The anchor bar 1618 and the clamp bar 1620 can each include holes 1622 such that upon alignment with one another (see FIG. 12) can received a fixation element such as a bolt 1630 configured to threadingly mate with a locking element such as a correspondingly threaded nut 1636 and a lock washer 1638. As mentioned above, the anchor bar 1618 and the clamp bar 1620 can vary in shape and dimensions as well as the number of holes 1622 extending therethrough. However, the anchor bar 1618 has at least a generally planar face 1619 that can lie flush with a correspondingly generally planar face of the clamp bar 1620 such that the sheet of pneumoform 610 extending between them within space 1624 can be snugly captured upon fixation with bolt 1630. As best shown in FIG. 12, the bolt 1630 can be inserted through a bore 1622*b* formed by the hole 1622 of the clamp bar 1620 aligned with the hole 1622 of the anchor bar 1618 when the planar faces of the bars are aligned and mated. The bolt 1630 can extend through the bore 1622*b* from an interior surface 1632 of the pneumoform 610 to an exterior surface 1634 of the pneumoform 610 such that the head of the bolt 1630 remains on the interior surface 1632 of the structure and the shaft of the bolt 1630 can be secured such as with a nut 1636 and washer 1638 on the exterior surface of the structure. Pneumoform 610 positioned within the space 1624 can be pre-drilled with holes to align with those on the bars 1618, 1620 or, if being used for the first time, the pneumoform 610 can be drilled with holes on site. As bolt 1630 and nut 1636 thread together, the planar face of the clamp bar 1620 moves toward the anchor bar 1618 until the space 1624 narrows fixedly capturing the keder 1612 of the pneumoform 610 and anchoring the pneumoform 610 to the slab 420.

Figure 13:
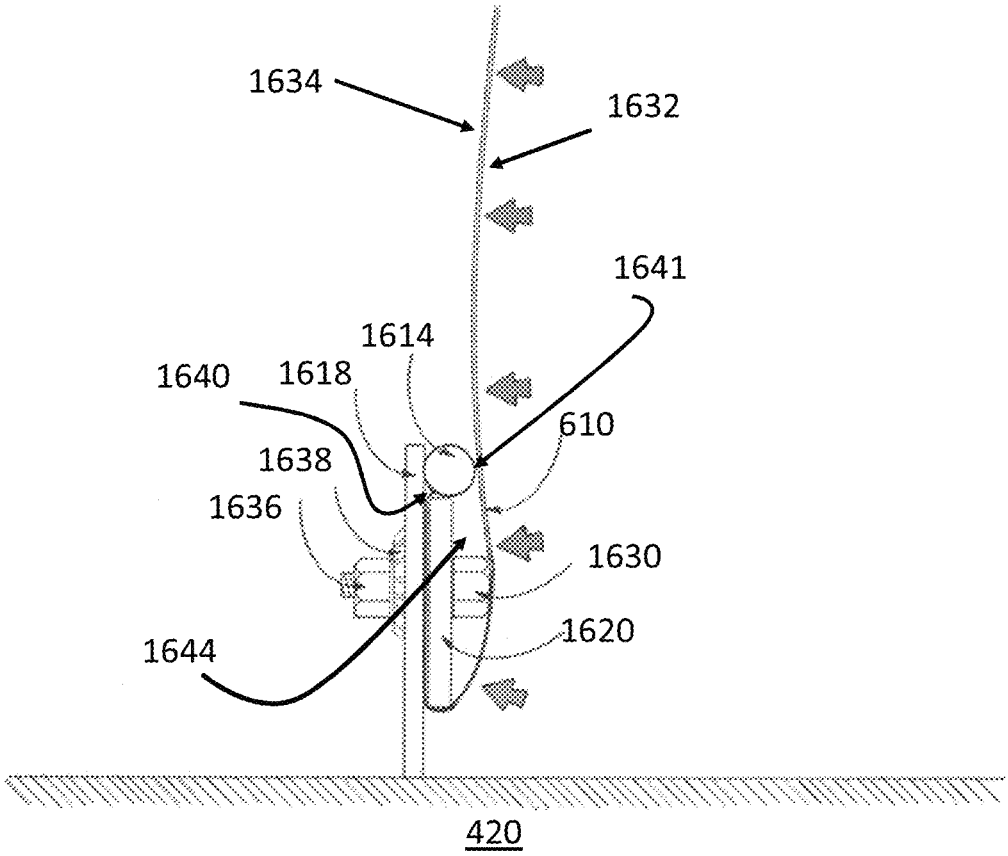
FIG. 13 is a side view of the anchoring assembly of FIG. 11 upon inflation of the pneumoform.

As mentioned above and best shown in FIG. 13, the keder 1612 can be captured between the anchor bar 1618 and the clamp bar 1620 such that the rail element 1614 of the keder 1612 remains above the upper surface 1626 of the clamp bar 1620 and the pneumoform 610 can wrap down around the lower surface 1628 of the clamp bar 1620. Thus, the keder 1612 can help to anchor the pneumoform 610 between the anchor bar 1618 and the clamp bar 1620 so that the pneumoform 610 is not pulled out from between the anchor bar 1618 and the clamp bar 1620 during inflation. The keder 1612 also creates a seal 1640 with the anchor bar 1618 and the clamp bar 1620 to create a fluid-tight volume within the pneumoform such that internal air pressure within the internal volume of the pneumoform can be increased to inflate the pneumoform and maintained constant during setting of the concrete shell. Thus, the keder 1612 provides for a self-sealing anchoring mechanism. The rail element 1614 of the keder 1612 can have an outer diameter that is larger than the width of the space 1624 between the clamp bar 1620 and anchor bar 1618 as well as the cross-sectional width of the clamp bar 1620 itself such that when the bolt 1630 is tightened down around the pneumoform 610 the keder 1612 is prevented from being pulled through the space 1624 between the anchor bar 1618 and the clamp bar 1620. A cushioned edging material such as a neoprene can be added to one or more regions of the clamp bar 1620 to prevent damage to the pneumoform 610 or the keder 1612. In an implementation, edging material can coat the lower surface 1628 of the clamp bar 1620 such that the pneumoform 610 is protected during inflation of the pneumoform 610.

Figure 14:
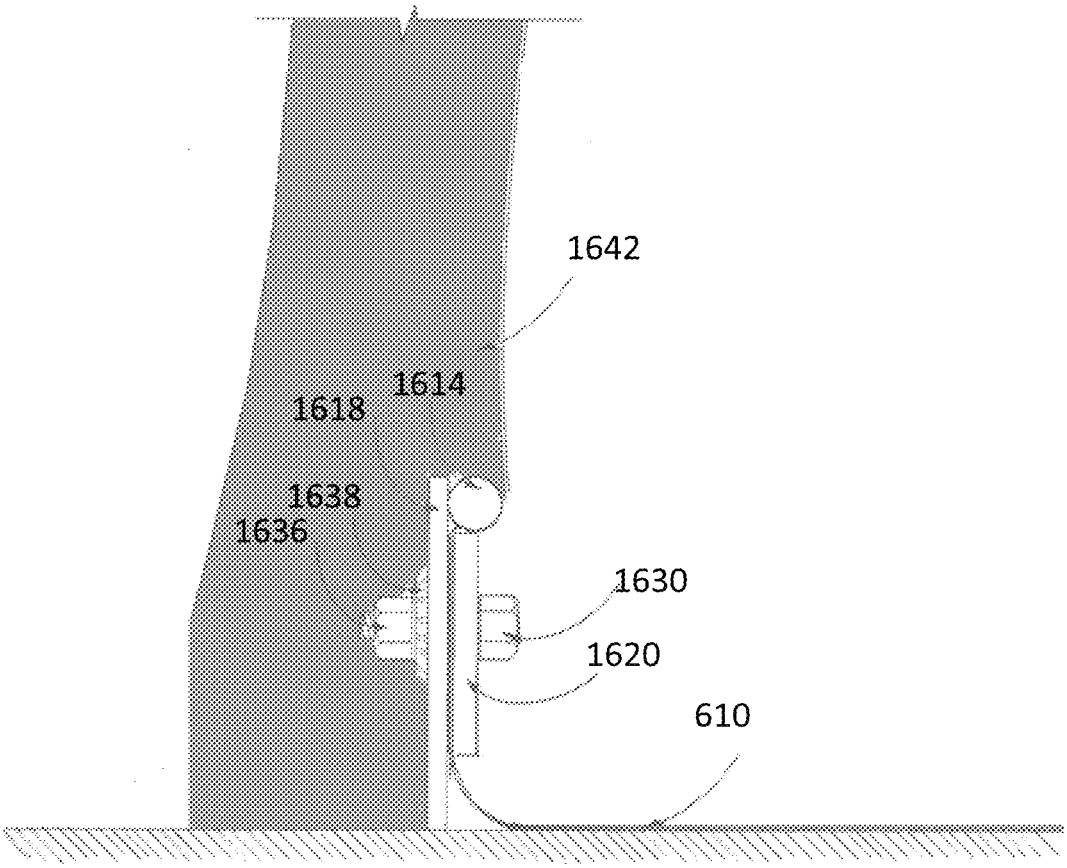
FIG. 14 is a side view of the anchoring assembly of FIG. 11 after application of concrete.

As mentioned above, in addition to providing the important function of anchoring the pneumoform 610 to the slab 420 during the fabrication of a structure, the anchoring assembly 1000 can also be self-sealing eliminating the need to separately seal the pneumoform during the fabrication process as in other implementations described herein. The keder 1612 also can create a second seal 1641 when the pneumoform 610 is inflated that provides for the pneumoform 610 to be more easily re-used. The internal air pressure (arrows) during inflation of the pneumoform 610 pushes the pneumoform 610 outward. A portion of the exterior surface 1634 of the pneumoform 610 near the outer perimeter is urged by the internal air pressure against the rail element 1614 of the keder 1612 creating the seal 1641. The seal 1641 creates a pocket 1644 within which the clamp bar 1620 and the head of the bolt 1630 is contained. The seal 1641 prevents concrete 1642 applied to the exterior surface 1634 of the pneumoform 610 from entering the pocket 1644 of the anchoring assembly 1000 where the head of the bolt 1630 is positioned between the clamp bar 1620 and the pneumoform 610. The seal 1641 is particularly useful where shell materials may be sprayed on and have a greater tendency to come into contact with the head of the bolt. As mentioned above, the seal 1641 can be created automatically upon the inflation of the pneumoform and prior to the application of the concrete. A keder of ½" in diameter or other dimensions may be coupled with a standard size bolt head to provide a seal that can withstand the intrusion of concrete that is sprayed on, such as Shotcrete, for example by pneumatically projecting at a high velocity once a specified internal air pressure for construction has been reached. As shown in FIG. 14, the concrete shell 1642 that had once surrounded the exterior surface 1634 of the pneumoform 610 (now shown deflated) terminates at the location of the seal 1640 between the keder 1612 and the pneumoform 610. The head of the bolt 1630 is readily accessible and due to the presence of the seal 1640 and the pocket 1644 is not covered in concrete 1642 such that the bolt 1630 can be accessed and unscrewed from the anchoring assembly 1000 through the action of the anchor washer 1638. The shaft of the bolt 1630 can be treated to prevent binding with the concrete shell 1642. Removal of the bolt 1630 and anchor bar 1618 allows the pneumoform 610 to be disengaged from the anchoring assembly 1000, recovered and re-used. The anchoring assembly 1000 is simple, auto-sealing, and allows the pneumoform 610 to be easily recovered and reused.

While this specification contains many specifics, these should not be construed as limitations on the scope of what is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results. Only a few examples and implementations are disclosed. Variations, modifications and enhancements to the described examples and implementations and other implementations may be made based on what is disclosed.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it is used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together."

Use of the term "based on," above and in the claims is intended to mean, "based at least in part on," such that an unrecited feature or element is also permissible.

What is claimed:

1. An assembly for erecting a reinforced structure of a hardening building material using a pneumoform, the assembly comprising:

an anchor bar having a first portion secured to a foundation and a second portion;

a clamp bar configured to be aligned with the second portion of the anchor bar;

a fixation element configured to extend through the clamp bar and the second portion of the anchor bar;

a pneumoform that is radially asymmetrical in shape and having an outer perimeter incorporating a keder, wherein the outer perimeter of the pneumoform is positionable within a space between the second portion of the anchor bar and the clamp bar such that upon locking the clamp bar to the anchor bar with the fixation element the keder is captured by the clamp bar creating a first seal and forming a fluid-tight internal volume configured to be inflated, and wherein a portion of an external surface of the pneumoform is urged against the keder upon application of pressure against an internal surface of the pneumoform creating a second seal and forming a pocket around at least a portion of the fixation element; and a matrix of rigid reinforcement bar positioned over the external surface of the inflated, radially aysmmetrical pneumoform providing reinforcement of a hardening building material applied to the external surface of the pneumoform.

2. The assembly of claim 1, wherein the second seal prevents the hardening building material applied to the pneumoform from entering the pocket and contacting the at least a portion of the fixation element.

3. The assembly of claim 2, wherein removal of the pressure deflates the internal volume and reveals the at least a portion of the fixation element.

4. The assembly of claim 3, wherein the at least a portion of the fixation element is removable and the pneumoform is removable from the assembly.

5. The assembly of claim 4, wherein the pneumoform is reusable after it is removed.

6. The assembly of claim 1, wherein the pneumoform has a single wall or a double wall configured to be inflated internally.

7. The assembly of claim 1, wherein the anchor bar has a first hole extending through the second portion and wherein the clamp bar has a second hole extending through the clamp bar.

8. The assembly of claim 7, wherein the fixation element extends through a bore created when the first and second holes align.

9. The assembly of claim 8, where the fixation element extends through a portion of the outer perimeter of the pneumoform positioned within the space when it extends through the bore.

10. The assembly of claim 9, wherein the fixation element is a bolt having a shaft and a head, wherein the shaft extends through the bore from an internal side of the pneumoform to an external side of the pneumoform such that the head of the bolt remains on the internal side of the pneumoform.

11. The assembly of claim 10, wherein the shaft of the bolt is secured with a lock nut or lock washer on the external side of the pneumoform locking the clamp bar to the anchor bar.

12. The assembly of claim 11, wherein the first seal forms collectively between the keder, the anchor bar and the clamp bar locked to the anchor bar.

13. The assembly of claim 12, wherein inflating the pneumoform increases internal air pressure within the fluid-tight volume.

14. The assembly of claim 13, wherein the second seal forms automatically upon inflating the fluid-tight internal volume.

15. The assembly of claim 13, wherein inflating the internal volume comprises injecting air using a blower, compressor or compressed air tank.

16. The assembly of claim 13, wherein the second seal forms a pocket around the clamp bar and the head of the bolt.

17. The assembly of claim 16, wherein the head of the bolt is positioned within the pocket between the clamp bar and the pneumoform.

18. The assembly of claim 13, wherein the first and second seals are each configured to maintain a seal during applying of the hardening building material to the external surface of inflated pneumoform over the matrix of reinforcement bars.

19. The assembly of claim 18, wherein the second seal prevents the hardening building material applied to the pneumoform from entering the pocket and contacting the head of the bolt.

20. The assembly of claim 19, wherein applying the hardening building material comprises pouring or spraying the hardening building material.

21. The assembly of claim 20, wherein the head of the bolt is revealed upon deflating the pneumoform, and wherein the bolt is configured to be accessed and removed from the bore after deflating the pneumoform.

22. The assembly of claim 21, wherein the pneumoform is configured to be recovered by disengaging the outer perimeter from within the space between the anchor bar and the clamp bar, and wherein the disengaged pneumoform is reusable to fabricate a second reinforced structure of hardening building material.

23. The assembly of claim 1, wherein the pneumoform is formed of a reinforced material that locks into position once a certain shape is achieved or an elastomeric material.

24. The assembly of claim 1, wherein the matrix of reinforcement bars is threaded through a plurality of spacers connecting the matrix of reinforcement bars, wherein each spacer is sized to provide measuring guidance for wall thickness of the hardening building material applied to the external surface of the pneumoform.

25. An assembly for erecting a reinforced structure of a hardening building material using a pneumoform, the assembly comprising:

a pneumoform that is radially asymmetrical in shape and formed of a reinforced material that locks into position once inflated under application of a constant air pressure, the pneumoform having an outer perimeter incorporating a keder;

an anchor bar having a first portion secured to a foundation and a second portion, wherein the anchor bar has a first hole extending through the second portion;

a clamp bar configured to be aligned with the second portion of the anchor bar, wherein the clamp bar has a second hole extending through the clamp bar; and a fixation element extending through a bore created when the first hole and the second hole align, through a portion of the outer perimeter of the pneumoform, and through the clamp bar and the second portion of the anchor bar, wherein the outer perimeter of the pneumoform is positionable within a space between the second portion of the anchor bar and the clamp bar such that upon locking the clamp bar to the anchor bar with the fixation element the keder is captured by the clamp bar creating a first seal and forming a fluid-tight internal volume configured to be inflated, and wherein a portion of an external surface of the pneumoform is urged against the keder upon application of pressure against an internal surface of the pneumoform creating a second seal and forming a pocket around at least a portion of the fixation element; and a matrix of rigid reinforcement bars threaded through a plurality of spacers connecting the matrix of rigid reinforcement bars, wherein the matrix is positioned over the external surface of the locked inflated pneumoform and each spacer is sized to provide measuring guidance for wall thickness of hardening building material applied to the external surface of the pneumoform.

* * * * *